US010524625B2

(12) United States Patent
James et al.

(10) Patent No.: US 10,524,625 B2
(45) Date of Patent: Jan. 7, 2020

(54) CLEANING DEVICE

(71) Applicant: SharkNinja Operating LLC, Needham, MA (US)

(72) Inventors: Samuel Emrys James, London (GB); Michael James Douglas, London (GB); David Stephen Clare, London (GB); Chris Pinches, Surrey (GB); Nicholas James Sardar, London (GB); Hugh James Croggon, Berkshire (GB); Damian Lee, Medfield, MA (US)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 16/420,498

(22) Filed: May 23, 2019

(65) Prior Publication Data

US 2019/0274498 A1 Sep. 12, 2019

Related U.S. Application Data

(63) Continuation of application No. 16/126,549, filed on Sep. 10, 2018.

(Continued)

(51) Int. Cl.
*A47L 5/16* (2006.01)
*A47L 9/06* (2006.01)

(Continued)

(52) U.S. Cl.
CPC ..... *A47L 5/16* (2013.01); *A47L 5/28* (2013.01); *A47L 9/00* (2013.01); *A47L 9/02* (2013.01);

(Continued)

(58) Field of Classification Search
CPC . A47L 13/256; A47L 5/16; A47L 5/28; A47L 9/00; A47L 9/02; A47L 9/0673;

(Continued)

(56) References Cited

U.S. PATENT DOCUMENTS 5,664,285 A * 9/1997 Melito ..... A47L 5/30 15/352
5,829,090 A 11/1998 Melito et al.

(Continued)

FOREIGN PATENT DOCUMENTS

CN 103356140 A 10/2013
CN 205181229 U 4/2016

(Continued)

OTHER PUBLICATIONS

International Search Report and Written Opinion dated Nov. 26, 2018 in connection with International Application No. PCT/US2018/050308.

(Continued)

*Primary Examiner* — Marc Carlson

(74) *Attorney, Agent, or Firm* — Wolf, Greenfield & Sacks, P.C.

(57) ABSTRACT

Methods and apparatus for cleaning a surface with a cleaning device having a body with a handle, a connector, and one or more cleaning heads that are removably attached to the cleaning device. Each cleaning head include a lower surface arranged to contact a surface to be cleaned and a dirt collection chamber permanently attached to the cleaning head. The cleaning head may include a support structure to support the dirt collection chamber and a cleaning sheet. The cleaning head also may include a suction nozzle. At least a portion of the dirt collection chamber may be made of a filter material.

8 Claims, 18 Drawing Sheets

Related U.S. Application Data

(60) Provisional application No. 62/577,878, filed on Oct. 27, 2017, provisional application No. 62/564,427, filed on Sep. 28, 2017, provisional application No. 62/556,883, filed on Sep. 11, 2017.

(51) Int. Cl.

| | |
|---|---|
| ***A47L 9/12*** | (2006.01) |
| ***A47L 5/28*** | (2006.01) |
| ***A47L 9/10*** | (2006.01) |
| ***A47L 9/00*** | (2006.01) |
| ***A47L 9/02*** | (2006.01) |
| ***A47L 9/32*** | (2006.01) |
| ***A47L 9/14*** | (2006.01) |
| ***A47L 13/256*** | (2006.01) |

(52) U.S. Cl.
CPC ..... *A47L 9/0673* (2013.01); *A47L 9/106* (2013.01); *A47L 9/12* (2013.01); *A47L 9/14* (2013.01); *A47L 9/32* (2013.01); *A47L 13/256* (2013.01)

(58) Field of Classification Search
CPC ... A47L 9/106; A47L 9/12; A47L 9/14; A47L 9/32
See application file for complete search history.

(56) References Cited

U.S. PATENT DOCUMENTS

| | | | | |
|---|---|---|---|---|
| 6,102,278 | A * | 8/2000 | Rothas | A47L 13/52 15/257.1 |
| 6,453,506 | B1 * | 9/2002 | Sumner | A47L 11/03 15/321 |
| 6,571,421 | B1 * | 6/2003 | Sham | A47L 5/28 15/320 |
| 6,966,098 | B2 * | 11/2005 | Sako | A47L 5/28 15/231 |
| 7,013,528 | B2 * | 3/2006 | Parker | A47L 5/28 15/364 |
| 7,048,804 | B2 * | 5/2006 | Kisela | A47L 5/24 134/21 |
| 7,137,169 | B2 * | 11/2006 | Murphy | A47L 5/24 15/320 |
| 7,150,069 | B2 * | 12/2006 | Hori | A47L 5/225 15/417 |
| 7,293,322 | B2 * | 11/2007 | Matousek | A47L 9/02 15/320 |
| 7,329,294 | B2 * | 2/2008 | Conrad | A47L 5/30 15/350 |
| 7,337,494 | B2 * | 3/2008 | Baer | A47L 9/06 15/246.2 |
| 7,409,745 | B2 * | 8/2008 | Dodson | A47L 9/06 15/403 |
| 7,673,361 | B2 * | 3/2010 | Policicchio | A47L 5/28 15/352 |
| 7,676,877 | B2 * | 3/2010 | Policicchio | A47L 11/33 15/41.1 |
| 7,861,351 | B2 * | 1/2011 | Ho | A47L 11/33 15/41.1 |
| 7,934,287 | B2 * | 5/2011 | De Soto-Burt | A47L 5/28 15/339 |
| 8,020,236 | B2 * | 9/2011 | Kaleta | A47L 11/33 15/4 |
| 8,065,778 | B2 * | 11/2011 | Kim | A47L 9/1463 15/319 |
| 8,341,802 | B2 | 1/2013 | Kim et al. | |
| 8,458,850 | B2 * | 6/2013 | Kasper | A47L 11/4027 15/320 |
| 8,495,781 | B2 * | 7/2013 | Dingert | A47L 11/22 15/320 |
| 9,504,366 | B2 | 11/2016 | Kasper et al. | |
| 9,661,968 | B2 * | 5/2017 | Bradbury | A47L 11/33 |
| 9,788,695 | B2 * | 10/2017 | Wood | A47L 7/00 |
| 9,901,231 | B2 * | 2/2018 | Tibberts | A47L 9/0488 |
| 2003/0159230 | A1 | 8/2003 | Oh | |
| 2004/0045126 | A1 | 3/2004 | Parker et al. | |
| 2004/0134016 | A1 | 7/2004 | Kisela et al. | |
| 2004/0134025 | A1 | 7/2004 | Murphy et al. | |
| 2004/0141798 | A1 * | 7/2004 | Garabedian, Jr. | A47L 13/12 401/279 |
| 2005/0115409 | A1 * | 6/2005 | Conrad | A47L 5/30 95/271 |
| 2007/0245511 | A1 | 10/2007 | Hahm et al. | |
| 2010/0024156 | A1 * | 2/2010 | De Soto-Burt | A47L 5/28 15/347 |
| 2010/0024157 | A1 * | 2/2010 | Vernon | A47L 5/28 15/403 |
| 2010/0115719 | A1 | 5/2010 | West et al. | |
| 2012/0311813 | A1 | 12/2012 | Gilbert, Jr. et al. | |
| 2013/0055521 | A1 * | 3/2013 | Lee | A47L 11/33 15/319 |
| 2014/0033470 | A1 * | 2/2014 | Codling | A47L 9/0673 15/415.1 |
| 2014/0033471 | A1 * | 2/2014 | Toole | A47L 9/02 15/415.1 |
| 2016/0174793 | A1 * | 6/2016 | Burke | A47L 9/0666 15/324 |
| 2017/0007086 | A1 * | 1/2017 | Kleine-Doepke | A47L 9/02 |
| 2018/0035855 | A1 | 2/2018 | Wood | |
| 2018/0055315 | A1 * | 3/2018 | Conrad | A47L 5/225 |
| 2018/0177367 | A1 * | 6/2018 | Amaral | A47L 9/1683 |
| 2018/0220861 | A1 * | 8/2018 | Zhang | A47L 7/0023 |
| 2019/0075984 | A1 * | 3/2019 | James | A47L 5/16 |

FOREIGN PATENT DOCUMENTS

| | | | |
|---|---|---|---|
| EP | 1 027 844 | A2 | 8/2000 |
| KR | 20170043227 | A | 4/2017 |
| WO | WO 2014/104503 | A1 | 7/2014 |

OTHER PUBLICATIONS

U.S. Appl. No. 16/429,306, filed Jun. 3, 2019, James et al.
U.S. Appl. No. 16/126,549, filed Sep. 10, 2018, James et al.
U.S. Appl. No. 16/420,453, filed May 23, 2019, James et al.
U.S. Appl. No. 16/420,475, filed May 23, 2019, James et al.
PCT/US2018/050308, Nov. 26, 2018, International Search Report and Written Opinion.

* cited by examiner

CLEANING DEVICE

CROSS-REFERENCE TO RELATED APPLICATIONS

This application claims priority under 35 U.S.C. § 120 and is a continuation of U.S. application Ser. No. 16/126,549, entitled "CLEANING DEVICE" and filed Sep. 10, 2018. U.S. application Ser. No. 16/126,549 claims priority under 35 U.S.C. § 119(e) to U.S. Provisional Application No. 62/556,883, entitled "HARDFLOOR CLEANER WITH A DISPOSABLE, MULTI-FUNCTION CLEANING HEAD" and filed Sep. 11, 2017, U.S. Provisional Application No. 62/564,427, entitled "HARDFLOOR CLEANER WITH A DISPOSABLE, MULTI-FUNCTION CLEANING HEAD" and filed on Sep. 28, 2018, and U.S. Provisional Application No. 62/577,878, entitled "HARDFLOOR CLEANER WITH A DISPOSABLE, MULTI-FUNCTION CLEANING HEAD" and filed on Oct. 27, 2017. The entirety of each of the documents listed above is incorporated herein by reference.

FIELD

Embodiments disclosed herein related generally to cleaning devices, and more specifically to vacuums.

DESCRIPTION OF THE RELATED ART

Cleaning devices are used in the home and office to clean floors and other surfaces. Various types of cleaning devices are known, such as vacuum cleaners and cleaning devices which use cleaning pads that are removably attached to the cleaning head of the device.

SUMMARY

According to one embodiment, an apparatus includes a cleaning head removably attachable to a cleaning device, the cleaning head having an upper side and a lower side, and a suction inlet, the lower side of the cleaning head arranged to contact a surface to be cleaned, and a dirt collection chamber permanently attached to the cleaning head and arranged to receive dirt from the suction inlet. The dirt collection chamber is not openable by a user to dispose of dirt in the dirt collection chamber without damaging the dirt collection chamber.

According to another embodiment, an apparatus includes a head removably attachable to a cleaning device, the head having an upper side and a lower side, the lower side arranged to contact a surface to be cleaned, and a suction inlet, and a dirt collection chamber attached to the head, and arranged to receive dirt from the suction inlet, the dirt collection chamber having a top wall and one or more side walls, wherein at least a portion of the one or more side walls is formed of an air filter.

According to still another embodiment, a cleaning device includes a body having a handle, a vacuum source, a connector arranged to attach a cleaning head to the body, a dirt collection chamber support removably attachable to the connector, the dirt collection chamber support having an underside arranged to contact a floor, and the dirt collection chamber support having an upper surface, and a dirt collection chamber protruding upwardly from the upper surface of the dirt collection chamber support, the dirt collection chamber formed at least in part by air filter material. The connector covers the air filter material when the dirt collection chamber support is attached to the connector such that the vacuum source can pull air through the air filter material.

According to yet another embodiment, a method of using a cleaning device is disclosed. The device includes a vacuum source, a body including a handle, and a connector to removably connect a cleaning head to the device. The method includes attaching a first cleaning head to the connector, the first cleaning head including a first suction nozzle and a first dirt collection chamber, operating the device to move dirt through the first suction nozzle and into the first dirt collection chamber, removing the first cleaning head from the connector, disposing of the first cleaning head, and attaching a second cleaning head to the connector, the second cleaning head including a second suction nozzle and a second dirt collection chamber.

According to another embodiment, a method of using a cleaning device is disclosed. The cleaning device includes a body, a handle, a vacuum source, and a head attached to the body. The method includes attaching a first dirt collection chamber support with an attached first dirt collection chamber to an underside of the head such that a suction nozzle is fluidically connected to the first dirt collection chamber, operating the device to suction dirt from a surface and into the first dirt collection chamber, removing the first dirt collection chamber support and attached first dirt collection chamber from the head, disposing of the first dirt collection chamber support and attached first dirt collection chamber, and attaching a second dirt collection chamber support with an attached second dirt collection chamber to the underside of the head such that a suction nozzle is fluidically connected to the second dirt collection chamber.

According to another embodiment, an apparatus includes a cleaning head removably attachable to a cleaning device, the cleaning head having an upper side and a lower side, the lower side of the cleaning head arranged to contact a surface to be cleaned, and a dirt collection chamber permanently attached to the cleaning head and arranged to receive dirt from a suction inlet through an air inlet opening. The dirt collection chamber has no openings other than the air inlet opening.

According to another embodiment, a cleaning apparatus includes a handle end and a floor-contacting end that is pivotable relative to the handle end. The apparatus also includes a suction source and a suction inlet positioned on the floor-contacting end. A disposable dirt collection chamber is attached to the floor contacting end and the dirt collection chamber has an air inlet opening that is arranged to receive dirt from the suction conduit at the suction inlet. The dirt collection chamber has no openings other than the air inlet opening.

It should be appreciated that the foregoing concepts, and additional concepts discussed below, may be arranged in any suitable combination, as the present disclosure is not limited in this respect.

The foregoing and other aspects, embodiments, and features of the present teachings can be more fully understood from the following description in conjunction with the accompanying drawings.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings:

FIG. 16 is an enlarged view of an airflow conduit of the cleaning appliance shown in

FIG. 15;

DETAILED DESCRIPTION

Figure 1:
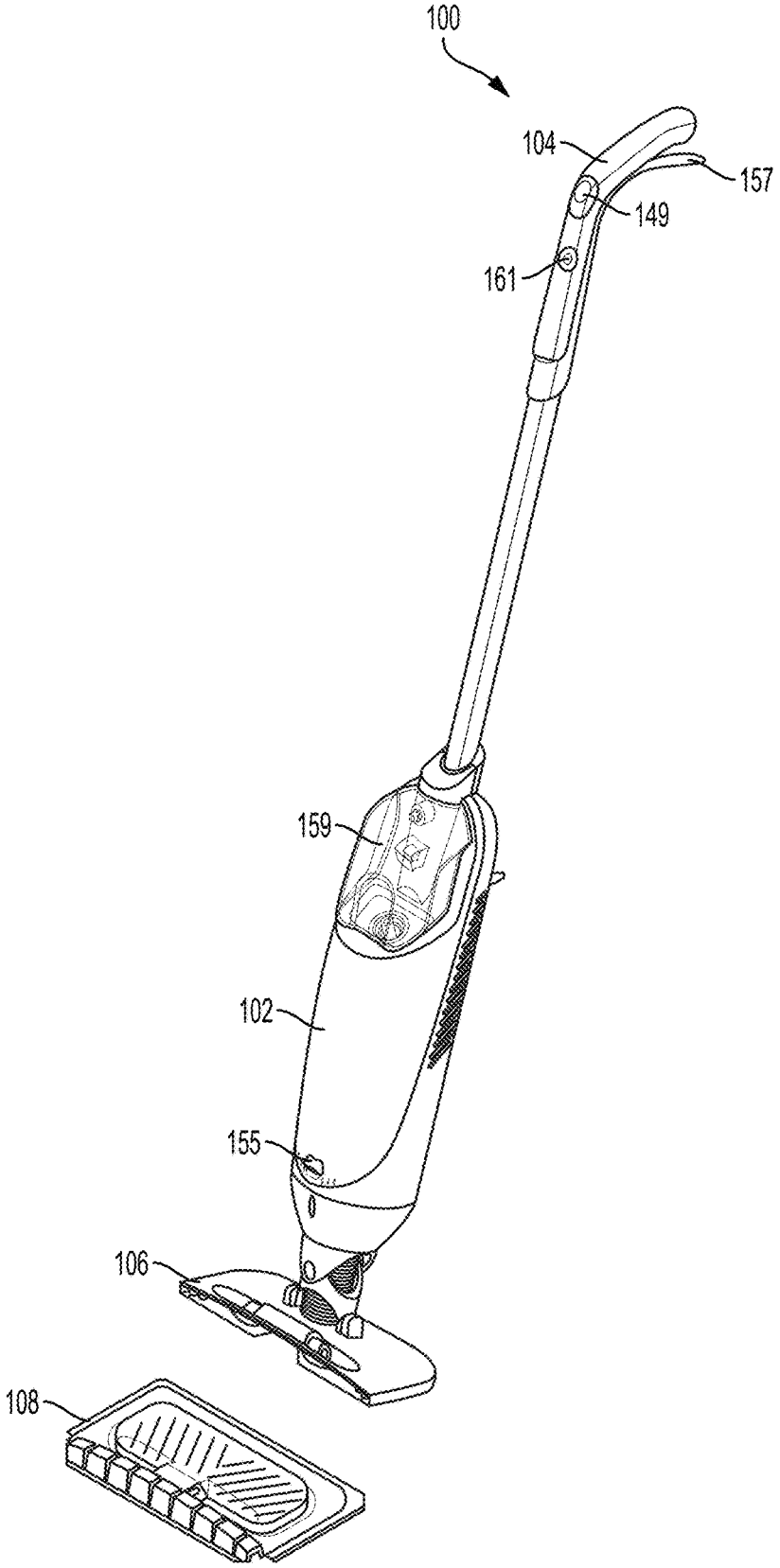
FIG. 1 is a perspective view of a cleaning device according to embodiments of the present disclosure.

Cleaning a surface, such as a hard floor or carpeted surface, can be challenging when there is a variety of different types of debris and spills, such as wet, dry, or mixed media spills. Cleaning devices are often suited for cleaning wet or dry debris, but not for cleaning both. As such, users typically need to use multiple cleaning devices to clean their floors. For example, the user may use a broom and/or vacuum cleaner to remove dry debris and then use a mop to clean up wet spills and/or to remove stains. In some instances, even with debris that is of the same type, a user may need to use multiple cleaning devices. For example, a vacuum may be successful at picking up large particles but may not capture smaller dust particles. Using multiple cleaning devices may be time consuming. For example, not only may the user need to use multiple cleaning devices, the user may need to use the same cleaning device more than once to fully clean the floor. For example, a user may need to sweep and/or vacuum the floor before mopping and then again after mopping, such as to pick up debris that was not removed from the surface prior to mopping or to pick up dirt or debris that was formed during mopping.

Using multiple cleaning devices also may be messy and/or require long setup time or after-use maintenance. For example, in some instances, the user may prefer to use a broom instead of a vacuum because of the readiness of the broom as compared to the time to set up the vacuum cleaner. With the broom, a user will sweep up and dispose of the dirt particles. Vacuums may require the user to either remove a bag from within the vacuum or repeatedly empty a dirt cup. Some cleaning devices have attempted to handle both wet and dry media, but some of these devices can have higher-set up times than using a broom and then a mop to clean a floor. Additionally, the after-use maintenance can be high for such devices, especially when cleaning liquids are involved. For example, some combination tools can become unsanitary or develop an odor if not properly cleaned after each use.

The inventors have recognized that advantages may be realized by having a cleaning head that collects wet and/or dry debris and is removably attachable to the cleaning device. A dirt collection chamber may be attached to the removable cleaning head to collect dirt being suctioned by the vacuum cleaner. The cleaning head may be constructed such that instead of opening the dirt collection chamber to dispose of the collected dirt, the dirt collection chamber is disposed of with the cleaning head.

For purposes herein, dirt being suctioned into the dirt collection chamber may include dry and/or wet media. For example, in some embodiments, a liquid applied to the surface may be absorbed by a cleaning sheet and also suctioned by the vacuum into the dirt collection chamber. In some embodiments, the wet media may be absorbed by at least a portion of the material used to form the dirt collection chamber. In some embodiments, the dirt collection chamber may be formed of a material which allows for fluid absorption into the material but does not allow for fluid transfer through the material. In such embodiments, fluid may not travel through the dirt collection chamber. For example, the material used to form the dirt collection chamber may be absorptive on the inner side of the dirt collection chamber, but impermeable.

In some embodiments, the dirt collection chamber may be permanently attached to the cleaning head. Without the need for detachment members, in some embodiments, the dirt collection chamber can be arranged to provide air filtration over a substantial surface area of the dirt collection chamber walls.

Advantages also may be realized if the user does not have to handle the wet or dirty cleaning head after operation of the cleaning device. For example, the cleaning device may be arranged to release the cleaning head after using the cleaning device such that the user does not have to grasp the cleaning head to discard it. With a permanently attached dirt collection chamber, and a release arrangement that does not require the user to touch the cleaning head, the cleaning head can be disposed of with limited or no user contact.

In some embodiments, the cleaning head includes a support structure to which the dirt collection chamber is attached. In such embodiments, the user may simply attach the cleaning head to the cleaning device, operate the cleaning device to move dirt from the surface and into the dirt collection chamber, remove the cleaning head, and dispose the cleaning head into a trash receptacle. Such a process may be repeated each time the user cleans the surface.

In some embodiments, the cleaning device may include a cleaning sheet and/or a liquid spray assembly to help with cleaning. In such embodiments, because the cleaning head may be the only part of the cleaning device to contact the surface and contain the wet and/or dry debris, the remainder of the cleaning device may remain clean throughout and after operation of the cleaning device.

As will be appreciated, the lower side of the cleaning head may directly contact the surface to be cleaned. In other embodiments, the lower side may indirectly contact the surface to be cleaned. For example, the lower side of the cleaning head may have one or more wheels to facilitate movement of the cleaning head on the surface. As another example of the lower side of the cleaning head indirectly contacting the surface, the cleaning head may include a cleaning sheet that contacts the surface to clean the surface during operation of the cleaning device. In some embodiments, the cleaning head includes a support arranged to hold the cleaning sheet on the cleaning head. In such embodiments, the cleaning sheet may be permanently or removably attached to the cleaning head.

In some embodiments, the cleaning head includes a suction inlet to move debris from the surface into the dirt collection chamber. In some embodiments, the suction inlet includes a suction nozzle that, in some embodiments, extends laterally across a front of the cleaning head. The suction nozzle may be permanently attached to the cleaning head in some embodiments. For example, the suction nozzle may be integrally formed with the support structure of the cleaning head. The suction nozzle also may be removably attached to the cleaning head in other embodiments. In some embodiments, the suction nozzle is fluidically connected to a vacuum source of the cleaning head.

In some embodiments, the dirt collection chamber is positioned on the upper side of the cleaning head. In some embodiments, the dirt collection chamber protrudes from the upper side of the cleaning head.

In some embodiments, the cleaning device includes a body having a handle, a vacuum, source, and a connector to connect the cleaning head to the cleaning body. In some embodiments, the connector includes a first engagement element and the cleaning head includes a second engagement element arranged to engage with the first engagement element to connect the cleaning head to the body of the cleaning device. In such embodiments, the cleaning head is held to the connector once the first and second engagement elements are engaged with one another.

In some embodiments, when the cleaning head is attached to the cleaning device, at least a portion of the dirt collection chamber may be covered by the cleaning device. For example, in some embodiments, the dirt collection chamber may be covered by the connector used to connect the cleaning head to the cleaning device. In some embodiments, the dirt collection chamber may be formed at least in part by an air filter. In such embodiments, the air filter portion is covered by the connector when the cleaning head is attached to the cleaning device, and suction is applied to the air filter.

In some embodiments, the body includes a spray nozzle and a liquid reservoir to supply liquid to the spray nozzle. As will be appreciated, the liquid reservoir may be removable or permanently attached to the cleaning device.

In some embodiments, the cleaning head is arranged to be disposable. For example, the cleaning head may include a support that is made of a thermoformed plastic or a cardboard pulp. In some embodiments, the cleaning heads are stackable. In some embodiments, the dirt collection chambers are arranged to be collapsible. For example, the dirt collection receptacle may include a bag.

FIG. 1 illustrates a cleaning device 100 according to embodiments of the present disclosure. As shown in this figure, the cleaning device 100 may include a body 102 with a handle 104, a connector 106, and a cleaning head 108 which is removably attachable to the body, such as via the connector. In some embodiments, the handle may have a length that is adjustable to allow a user to adjust the height of the cleaning device. For example, the handle may be telescoping to increase or decrease the length of the handle.

Figure 2:
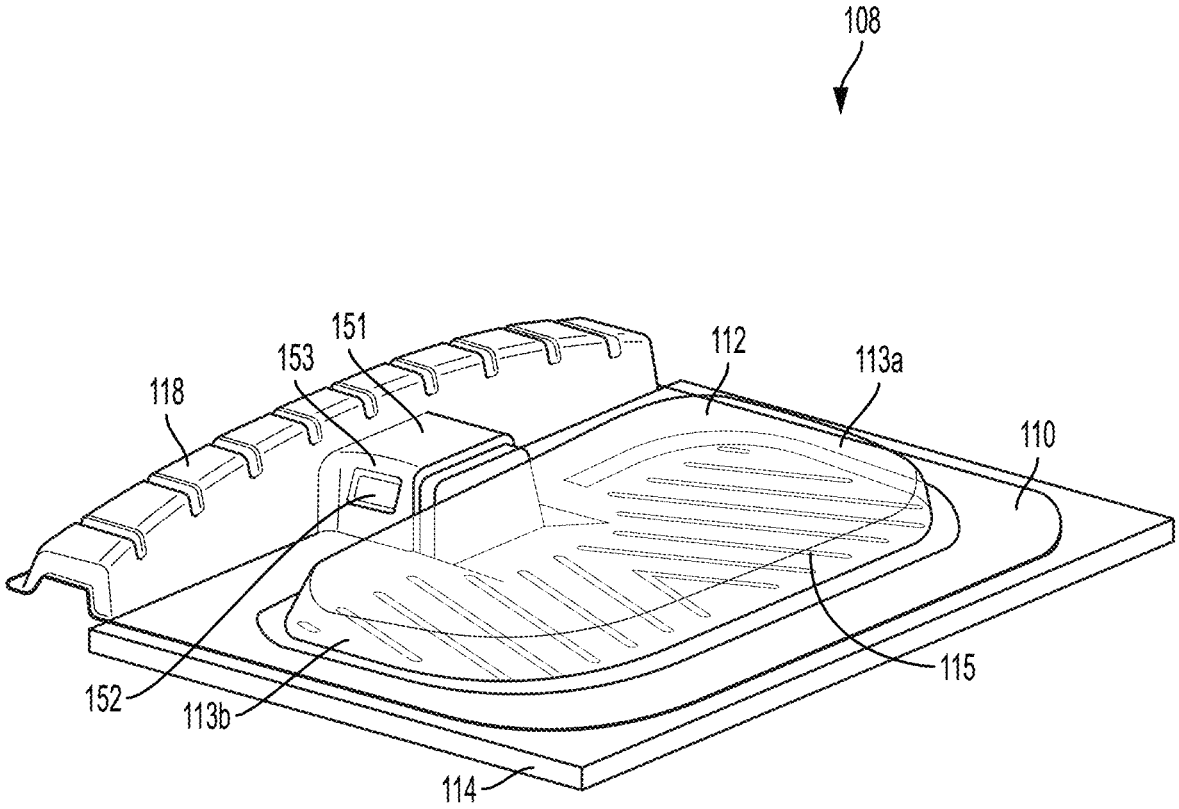
FIG. 2 is a top perspective view of a cleaning head according to some embodiments.
Figure 3:
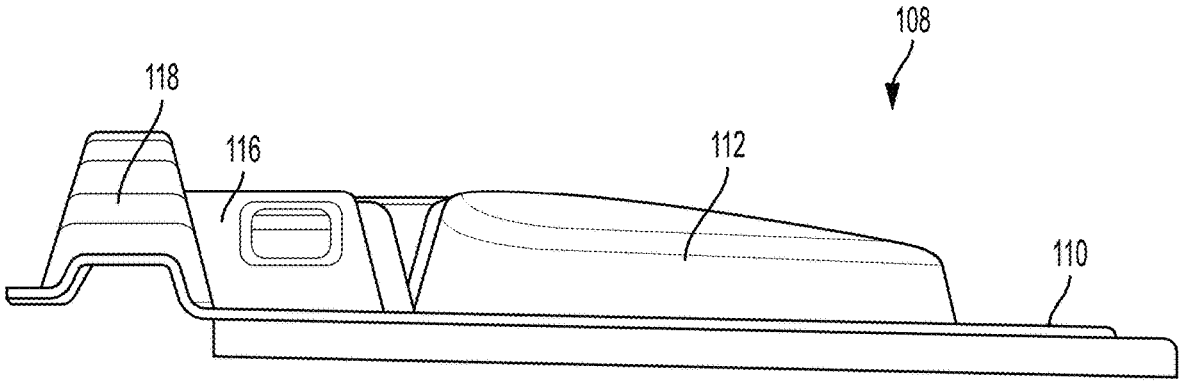
FIG. 3 is a side view of the cleaning head of FIG. 2.
Figure 4:
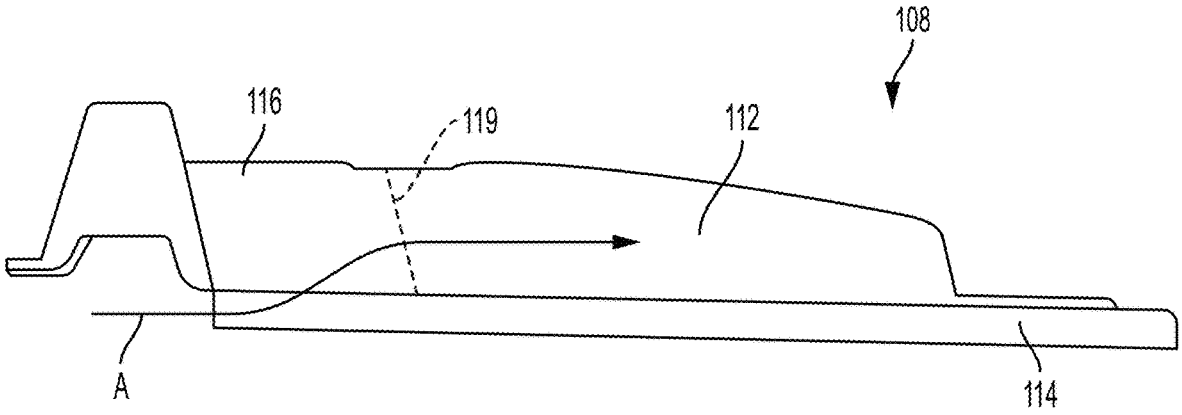
FIG. 4 is a cross-sectional side view of the cleaning head of FIG. 3.

As shown in FIGS. 2-4, the cleaning head 108 may include a dirt collection chamber 112 to collect debris removed from the surface. As will be appreciated, the dirt collection chamber may be a dirt cup, a dirt bin, or any other suitable container for collecting dirt such as dust or wet and/or dry media. In some embodiments, the cleaning head may have a support structure 110. In such embodiments, the dirt collection chamber 112 may be permanently attached to the support structure. For example, the dirt collection chamber 112 may be glued, heat sealed, or otherwise permanently affixed to the support structure. In some embodiments, as shown in FIG. 4, the support structure is a substantially planar support frame, although the support structure may have other suitable arrangements. The support structure is arranged to contact a surface to be cleaned in the illustrated embodiment. In some embodiments, the support frame may directly contact the surface to be cleaned, though in other embodiments the support frame may indirectly contact the surface to be cleaned (e.g., via one or more wheels, a cleaning sheet, or a cleaning sheet with a backing pad).

In some embodiments, the dirt collection chamber 112 protrudes upwardly from the support structure 110. For purposes herein, the term "protruding upwardly" means that the dirt collection chamber protrudes away from the support structure in a direction away from the surface being cleaned. In some embodiments, the support frame includes one or more grooves 115 to increase the rigidity of the support frame.

As will be appreciated, the support structure and the dirt collection chamber need not be the same shape or size. For example, the support structure may be larger than the dirt collection chamber in some embodiments. In some embodiments, the support structure may have a substantially rectangular shape (top view) while the dirt collection chamber has a generally oval, racetrack, or otherwise curved shape (top view).

In some embodiments, as shown in FIGS. 2-6, the cleaning head may include a cleaning sheet 114. The cleaning sheet may be attached to the lower surface of the cleaning head. The lower surface of the support structure may be positioned opposite to the surface on which the dirt collection chamber is attached to the support structure. In some embodiments, the cleaning sheet may be larger than the support structure, although it may be the same size as, or smaller than, the support structure in other embodiments. The support structure and cleaning sheet may be the same shape or they may have different shapes.

Figure 12:
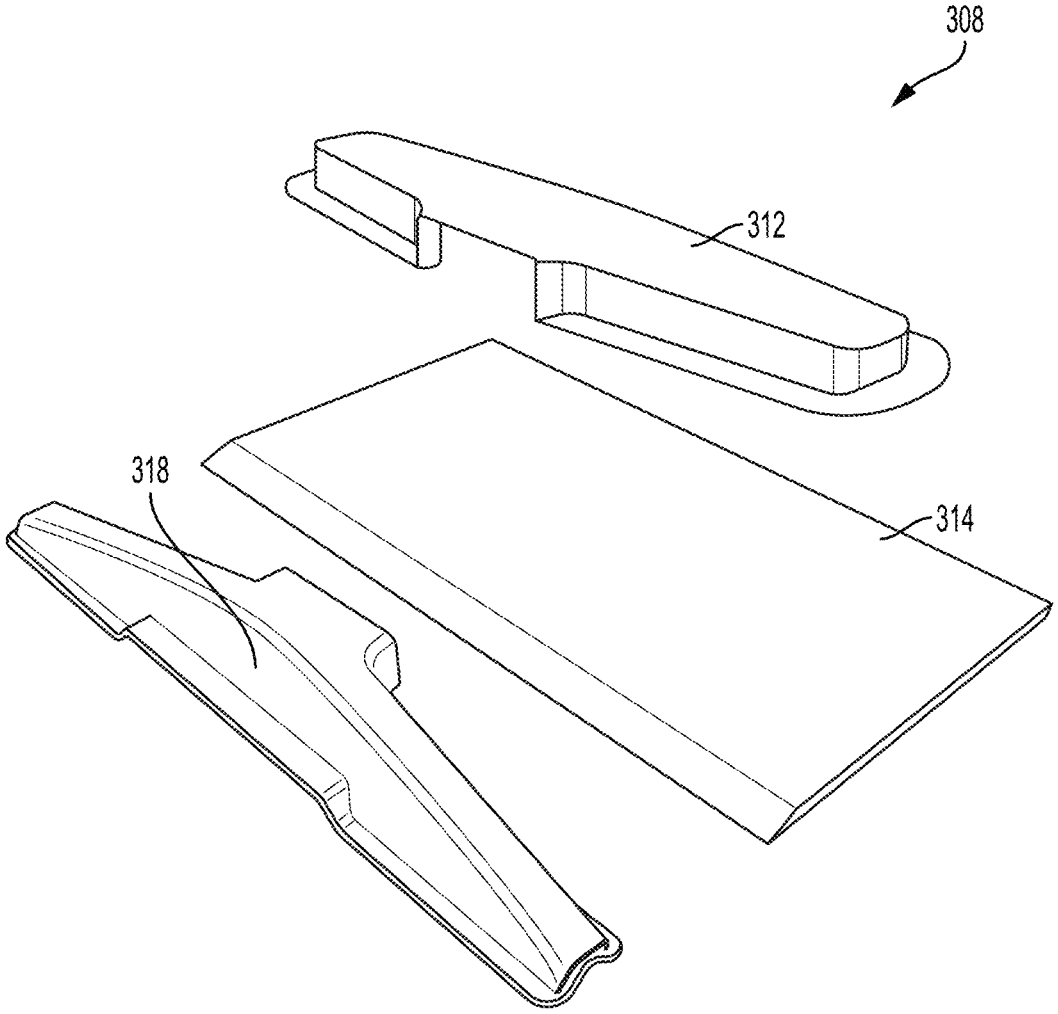
FIG. 12 is an exploded view of a cleaning head according to another embodiment.

In some embodiments, the cleaning sheet may be permanently attached to the cleaning head, such as permanently attached to the support structure. For example, the cleaning sheet may be glued, heat sealed, or otherwise fixedly attached to the support structure. In some embodiments, as shown in FIG. 12, the cleaning sheet 314 may form the support structure of the cleaning head 308. In such embodiments, the dirt collection chamber 312 may be directly attached to an upper surface of the cleaning sheet 314.

Figure 10:
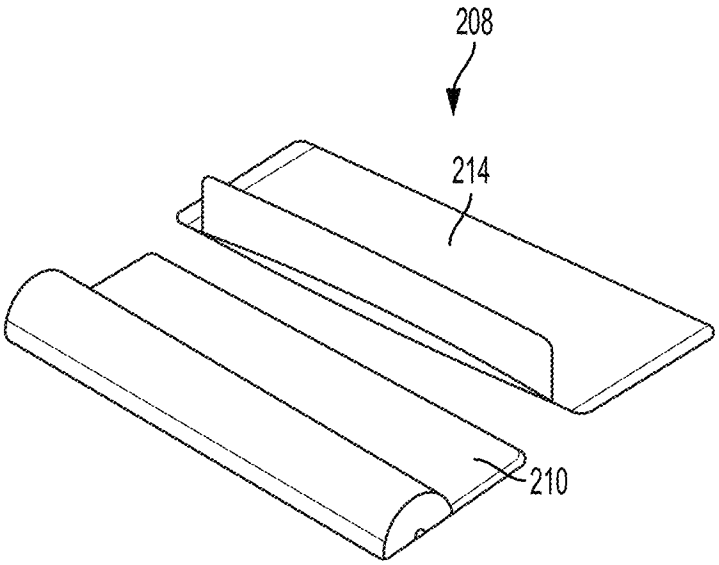
FIG. 10 illustrates a cleaning sheet being attached to the cleaning head of FIG. 9.
Figure 9:
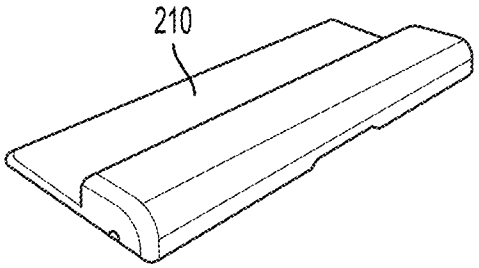
FIG. 9 is a cleaning head according to another embodiment.
Figure 11:
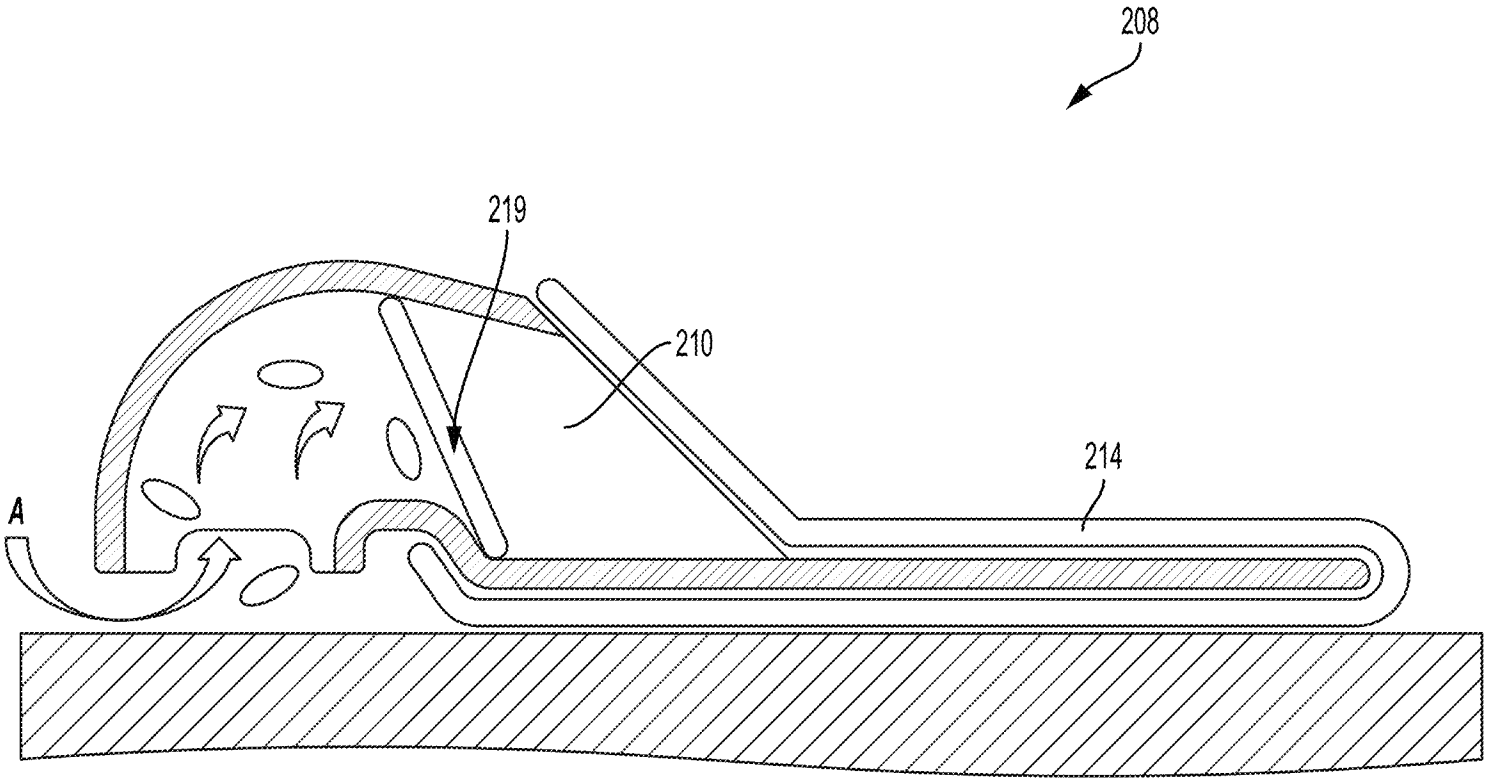
FIG. 11 is a cross-sectional side view of the cleaning head of FIGS. 9 and 10.

In some embodiments, the cleaning sheet may be removably attached to the cleaning head. For example, the support structure may have one or more hook and loop fasteners that engage with hook and loop fasteners on the cleaning sheet. In another embodiment, as shown in FIGS. 9-10, the cleaning sheet 214 may include a pocket into which the support structure 210 is slidably inserted. As will be appreciated, in such embodiments, the cleaning sheet may be attachable to the cleaning head, such as to the support structure and/or the dirt collection bin, prior to attaching the cleaning head to the cleaning device. The cleaning sheet also may be attachable to the cleaning head after the cleaning head is attached to the cleaning device.

In some embodiments, as shown in FIG. 3-4, the cleaning head may include an airflow conduit 116 arranged to transfer debris into the dirt collection chamber 112. As will be appreciated, the airflow conduit may include a tube, pathway, passageway, or simply an opening to the dirt collection chamber. In some embodiments, such an opening in the dirt collection chamber is always open. In other embodiments, such an opening may be selectively openable and closeable. For example, as will be described, the cleaning head may include a valve selectively openable to allow debris into the dirt collection chamber and selectively closeable to prevent debris from escaping the dirt collection chamber.

In some embodiments, the cleaning head includes a suction inlet arranged to transfer debris from the surface into the dirt collection chamber, such as via the airflow conduit. In some embodiments, the suction inlet includes a suction nozzle 118. In some embodiments, as shown in FIG. 2, for example, the suction nozzle may extend laterally along a front portion of the cleaning head. The suction nozzle may have any suitable shape and size. The suction nozzle may extend along an entire width of the cleaning head in some embodiments.

Figure 5:
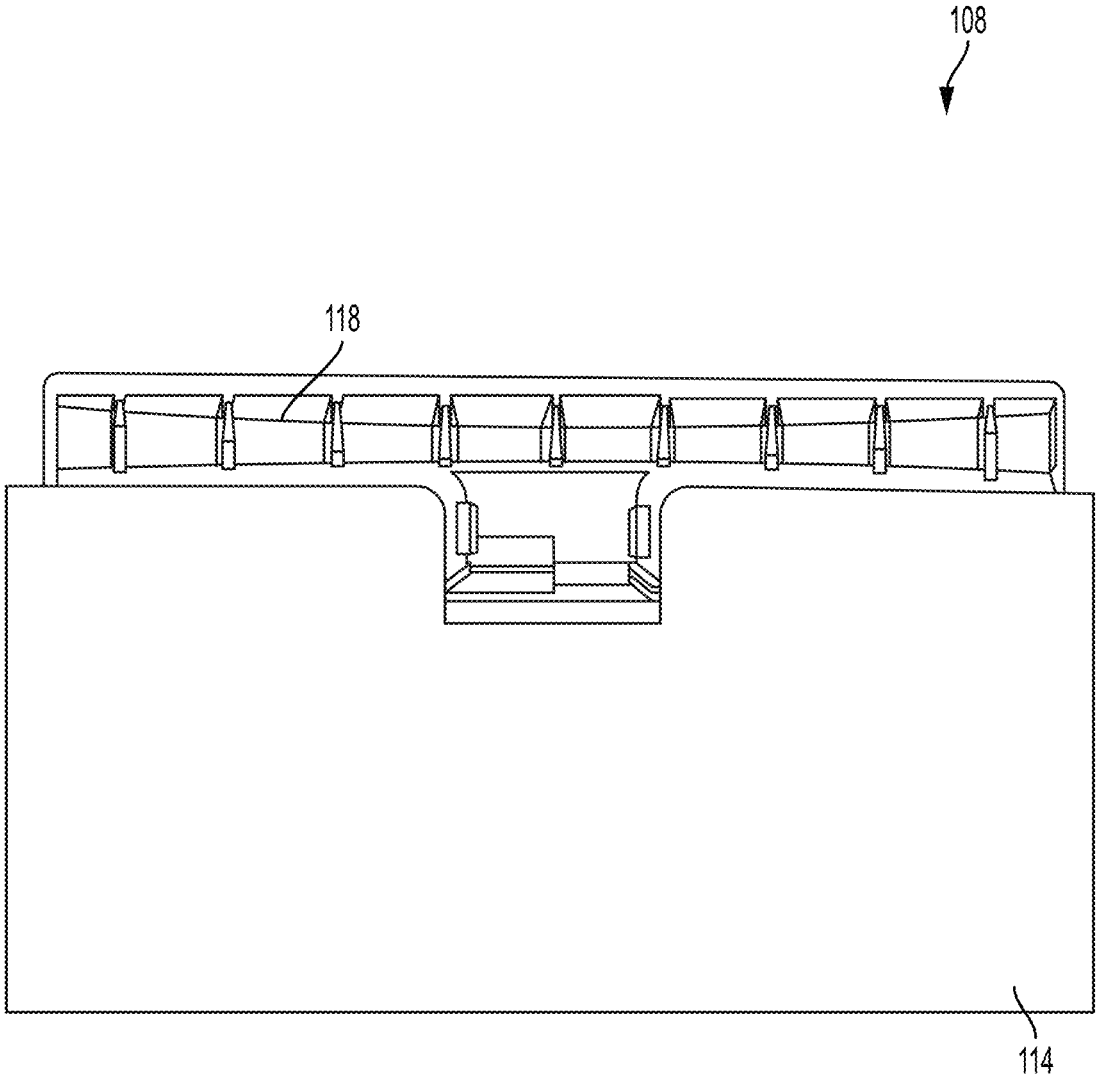
FIG. 5 is a bottom view of the cleaning head of FIG. 2.
Figure 6:
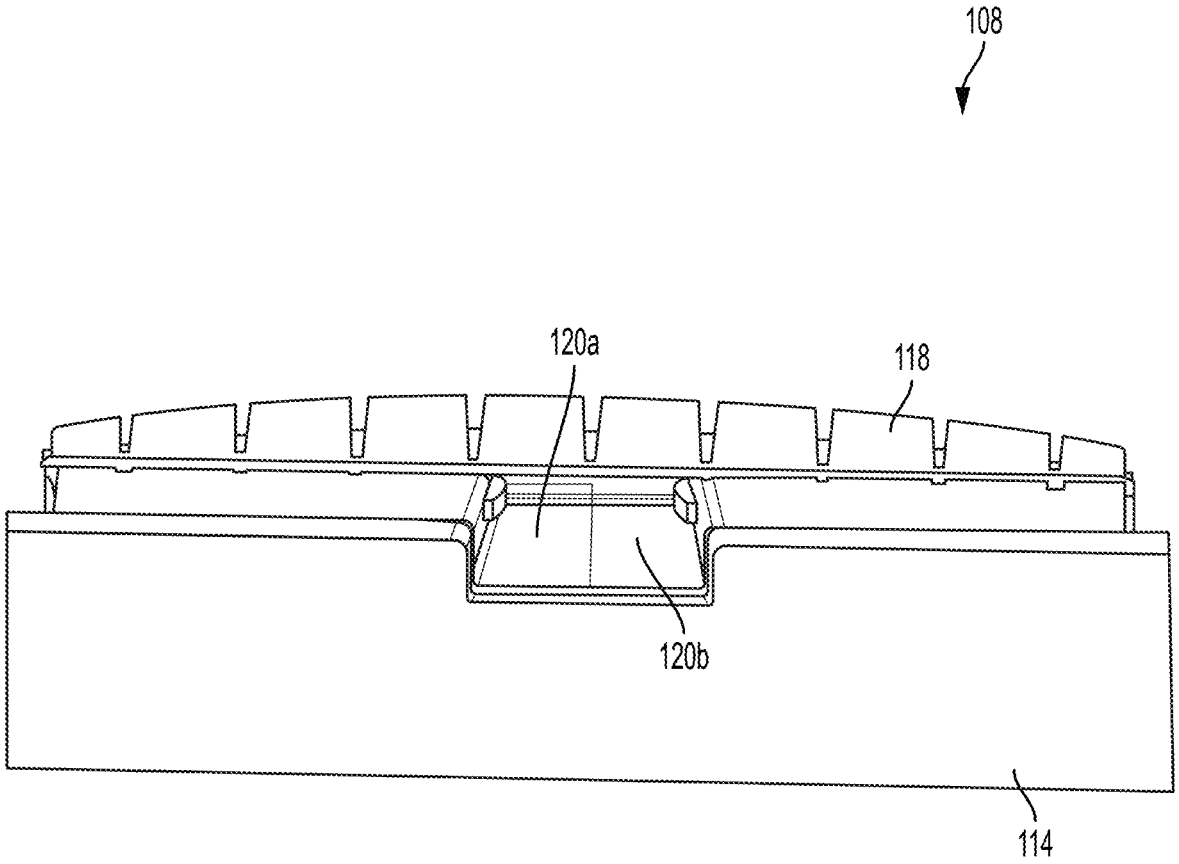
FIG. 6 is an enlarged bottom perspective view of the cleaning head of FIG. 2.

In some embodiments, the suction nozzle 118 may be attached to the support structure 112. For example, the suction nozzle may be glued, heat sealed, or otherwise permanently attached to the support structure. In some embodiments, such as that shown in FIGS. 2 and 9-10, the suction nozzle may be attached by being integrally formed with the support structure. As shown in FIG. 12, in some embodiments, the nozzle 318 may be attached to the cleaning sheet 314. The suction nozzle also may be removably attached to the support structure, or to another suitable portion of the cleaning head In some embodiments, such as those shown in FIGS. 3-4, the cleaning sheet may be arranged to elevate the support structure away from the surface to be cleaned such that the suction nozzle does not contact the surface. In some embodiments, the nozzle may be positioned between 5 mm and 8 mm from the surface. In some embodiments, the nozzle may be positioned 5.5±0.5 mm from the surface. As shown in FIGS. 5-6, the cleaning sheet may be positioned behind the suction nozzle such that debris may be suctioned into the nozzle before the cleaning sheet reaches the debris.

Figure 13:
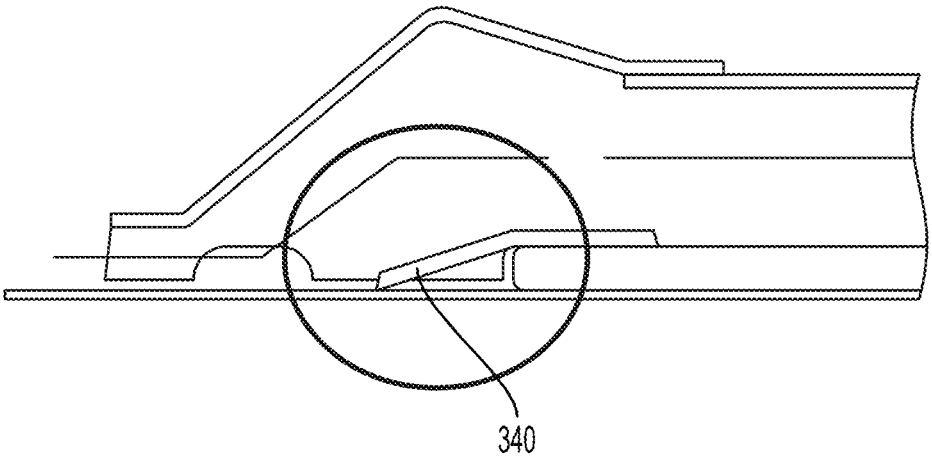
FIG. 13 is a cross-sectional side view of a cleaning head according to other embodiments.

In some embodiments, as show in FIG. 13, the cleaning head may include a sealing surface 340 arranged to create a seal between the cleaning head and the surface being cleaned. In some embodiments, the sealing surface 340 may include a recycled cardboard pulp material that is attached to the cleaning head (such as to the support structure). The seal also may be formed of a rubber wiper blade.

In some embodiments, the suction nozzle may be sized to allow both large and small particles to be suctioned into the dirt collection chamber while still maintaining a high air velocity to facilitate pickup. Large particles may be collected through the center of the suction nozzle at a larger central opening, while small particles may be collected along the entirety of the suction nozzle.

Figure 17:
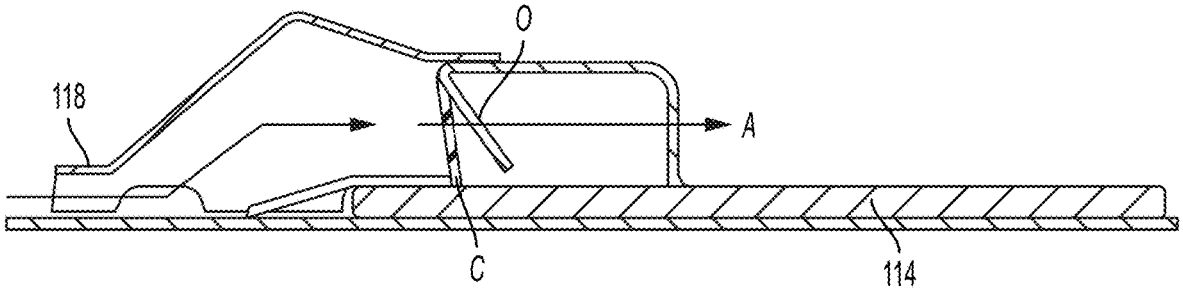
FIG. 17 is a schematic cross-sectional side view of a cleaning head according to another embodiment.

In some embodiments, the dirt collection chamber may be arranged to maintain the dirt within the dirt collection chamber once the dirt has been moved into the dirt collection chamber. In some embodiments, the dirt collection chamber includes a lip and internal valve that keeps dust, dry media, and/or wet media within the dirt collection chamber once the dirt has been moved into the chamber, thereby preventing dust and dry media from exiting via the suction inlet, such as when the vacuum is powered off. In some embodiments, as shown in FIGS. 4 and 6, the dirt collection chamber may include a selectively openable and closeable valve 119 at or near the air flow conduit. In some embodiments, the valve may include one or more flaps 120*a*, 120*b* that are pivotable between an open position O (see FIG. 17) when the vacuum is turned on and a closed position C (see FIG. 17) when the cleaning device is turned off.

As will be appreciated, in some embodiments, the valve may be integrally formed with at least a portion of the cleaning head. For example, the valve may be integrally formed with the support structure. The valve also may be separately formed and attached to the cleaning head. For example, they valves may be fixedly attached to the dirt collection chamber.

Figure 14:
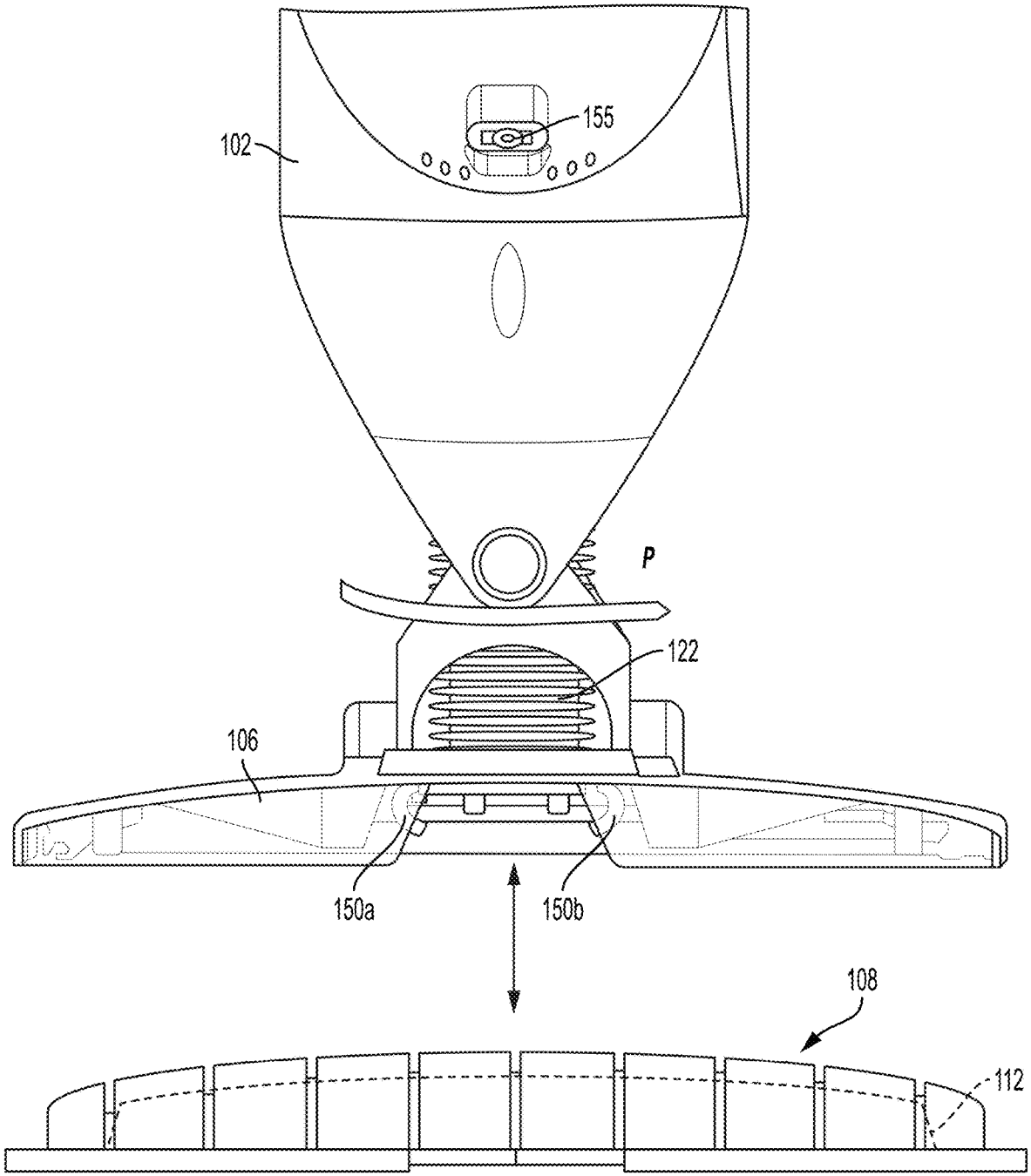
FIG. 14 shows a cleaning appliance and cleaning head removably attachable to the cleaning appliance according to some embodiments.

As shown in FIG. 14, in some embodiments, the connector 106 is pivotally connected to the body 102 of the cleaning device to allow the cleaning head 108 to be pivotable relative to the body (see arrow P). As will be appreciated, the connector may pivot about one or more axes of rotation when moving relative to the body of the cleaning device.

In some embodiments, when the cleaning head is connected to the connector, at least a portion of the dirt collection chamber 112 of the cleaning head is covered by the connector. In some embodiments, the entire dirt collection chamber is covered by the connector. The connector also may cover part of the support structure. In some embodiments, the connector does not cover the suction nozzle, though in other embodiments, the connector may be arranged to cover at least a portion of the suction nozzle or the entire nozzle.

Figure 15:
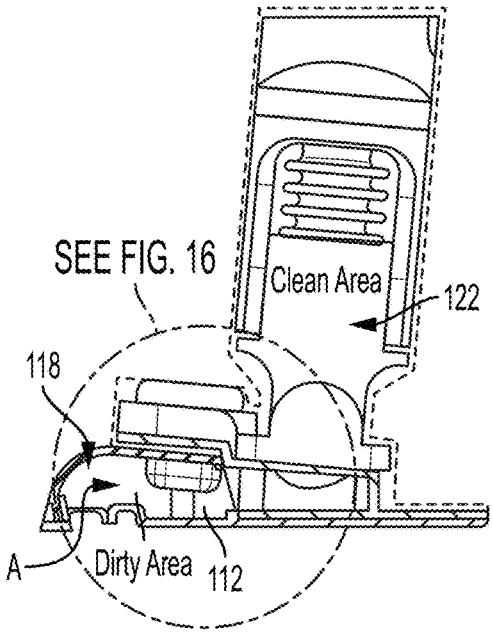
FIG. 15 is a cross-sectional side view of a cleaning appliance according to other embodiments.
Figure 16:
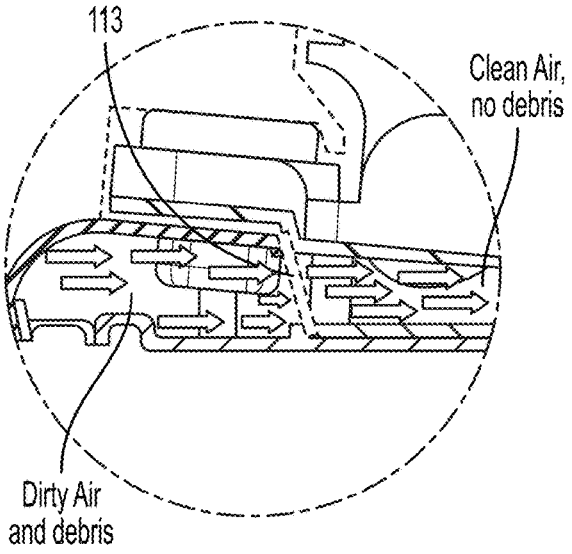

In some embodiments, at least a portion of the dirt collection chamber may be formed of a filter material. As will be appreciated, such filter material may filter the debris and moisture such that the debris and moisture stays in the dirt collection chamber as the air flows toward the suction source. As illustrated in FIGS. 15 and 16, for example, dirty air, debris, and/or moisture may remain in the dirt collection chamber 112 as clean air flows towards the suction source (see arrow A). In such an example, air flows through a portion 113 of the dirt collection chamber formed of a filter material. In some embodiments, as illustrated in FIG. 2, the dirt collection chamber may include a top 113*a* and one or more sides 113*b*. In some embodiments, at least one of the sides 113*b* is made of a filter material. In some embodiments, the entire dirt collection chamber is made of a filter material.

In some embodiments, the cleaning device may have an additional filter to remove particles that escape through the filter of the dirt-collection chamber. In some embodiments, the filter may be located on the connector 106.

Figure 7:
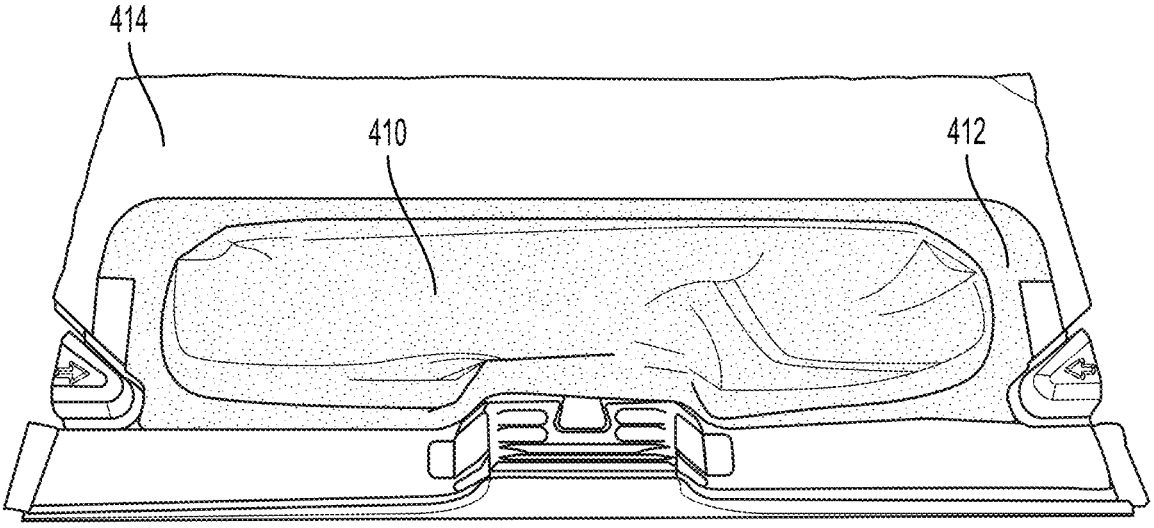
FIG. 7 is a cleaning head according to another embodiment.
Figure 8:
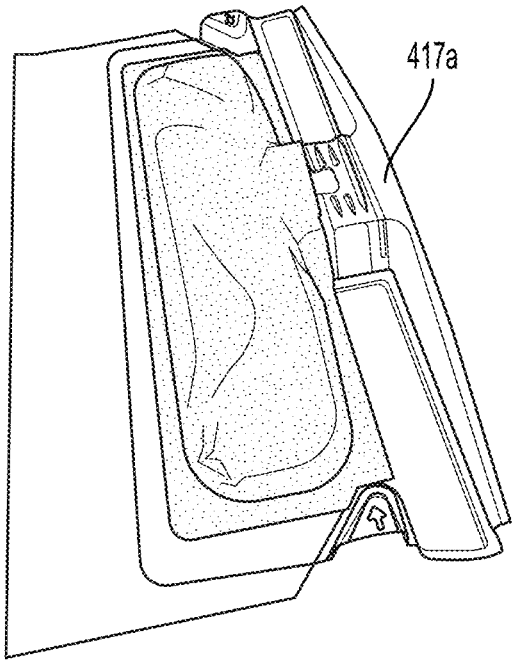
FIG. 8 is a side perspective view of the cleaning head of FIG. 7.
Figure 18:
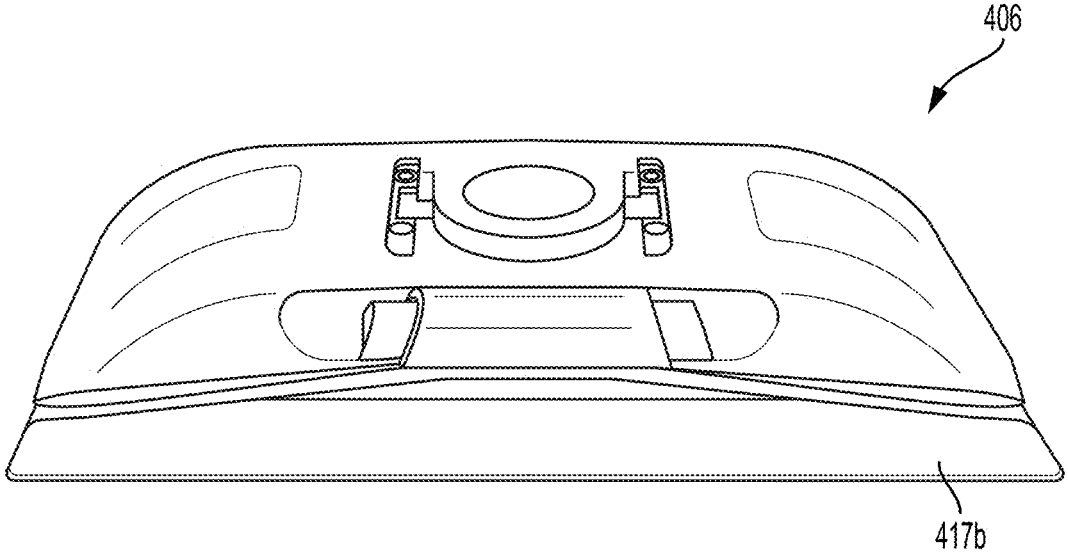
FIG. 18 is a front perspective view of a connector of a cleaning appliance according to another embodiment.
Figure 19:
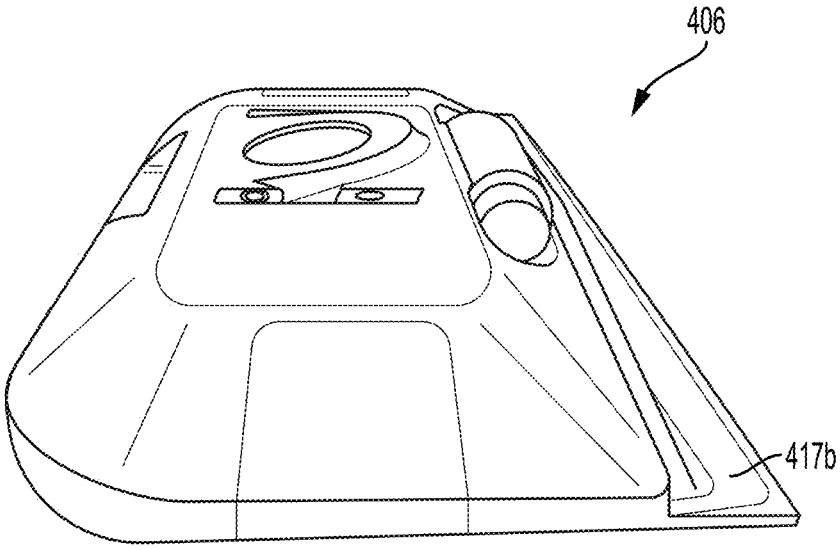
FIG. 19 is a side perspective view of the connector shown in FIG. 18.

As will be appreciated, although the cleaning heads have been shown and described as having a suction nozzle for moving debris from the surface into the dirt collection receptacle, in some embodiments, the suction nozzle or at least a portion of the suction nozzle may be on the connector. For example, as shown in FIGS. 7-8, the cleaning head may have only a portion of the suction nozzle 417*a*, and the connector may have another portion of a suction nozzle 417*b* (see FIGS. 18-19). In some embodiments, the connector 406 may cover at least a portion of the suction nozzle 417*a* on the cleaning head. In some embodiments, the cleaning head and connector remove debris from the floor to the dirt collection chamber. In still another embodiment, the cleaning head may not include a nozzle. In such embodiments, the connector may include a suction nozzle.

According to another aspect of the disclosure, the cleaning head is removably attachable to the cleaning device. In some embodiments, the connector includes an engagement element that engages with a corresponding engagement element to hold the cleaning head to the cleaning device during operation. As will be appreciated, the handle may include an actuator 161 to selectively engage and disengage the engagement elements on the cleaning device.

In some embodiments, as shown in FIG. 14, the engagement elements include jaws 150*a* 150*b* that are selectively pivotable between an engaged position (e.g., toward one another) and a released position (e.g., away from one another). In some embodiments, each jaw may be separately moveable between the released and engaged positions. In other embodiments, the first and second jaws move simultaneously between the engaged and released positions. As will be appreciated, the jaws may be biased toward the engaged position such that when the user releases the actuator, the jaws engage with corresponding recesses 152 (see FIG. 2) on an engagement element 151 the cleaning head 108).

In some embodiments, the jaws may be moveable between the closed and engaged position via the engagement element on the cleaning head. For example, the engagement element 151 may have a tapered contact surface 153 that contacts the jaws and moves the jaws away from one another until the jaws move into the corresponding recesses 152, at which point the jaws may move towards one another into the engaged position.

Figure 22:
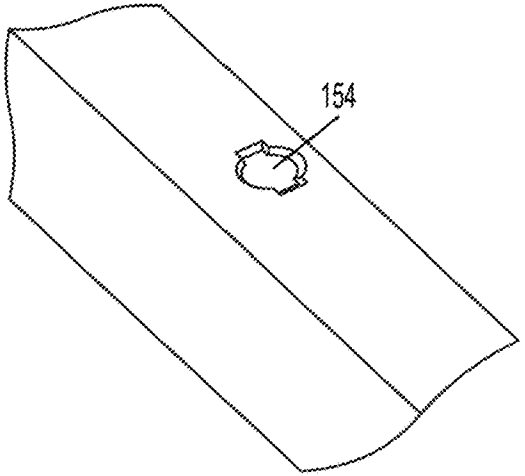
FIG. 22 shows a top portion of a cleaning head according to one embodiment.
Figure 21:
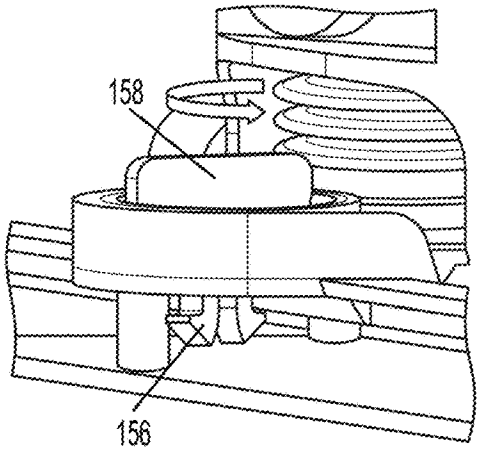
FIG. 21 shows an engagement member for connecting a cleaning head to the connector according to one embodiment.
Figure 20:
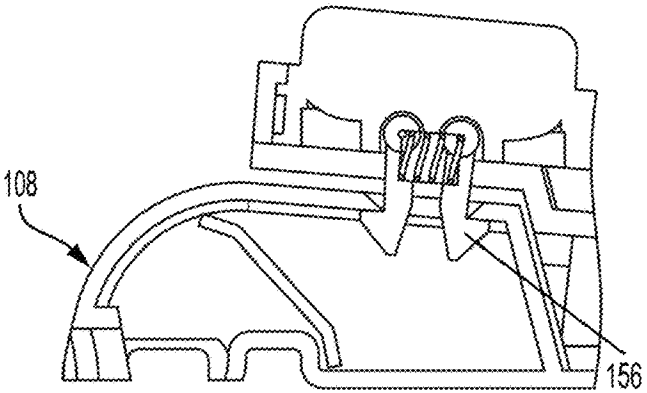
FIG. 20 is a cross-section side view of a cleaning head attached to a connector according to some embodiments.

In other embodiments, as shown in FIG. 20-22, the cleaning head may an opening 154 into which a pair of jaws 156 is insertable. The user may then twist an actuator 158 attached to the jaws to lock the cleaning head to the connector. In such embodiments, the jaws may be spring-biased.

In some embodiments, the cleaning head is made of rigid material such that the cleaning head may maintain its shape and allow the nozzle to maintain its shape once the cleaning head is held to the connector. For example, the cleaning head may be made of a cardboard or thermoformed plastic material. In some embodiments, the support structure includes grooves to increase the rigidity of the support structure.

In some embodiments, the cleaning device includes a vacuum source arranged to apply a vacuum to move dirt from the floor to be cleaned and into the dirt collection chamber. As shown in FIGS. 4, 11, and 15-16, the vacuum source provides a suction effect, pulling air and any loose debris through the suction nozzle, airflow conduit, and into the dirt collection chamber. In such arrangements, the suction nozzle is fluidically connected to the airflow conduit and to the dirt collection chamber. In some embodiments, the vacuum source may be controlled via an actuator 149 located on the handle (see FIG. 1).

In some embodiments, the vacuum source may be located inside of the body of the cleaning device. For example, the vacuum source may be located near or in a liquid reservoir 159. In some embodiments, the vacuum may remain attached to the handle when the liquid reservoir is removed. In some embodiments, the vacuum source may be removed with the liquid reservoir. The vacuum source also may be located and may be located proximate to the connector and removable cleaning head. In some embodiments, the vacuum may comprise a motor. The vacuum source may include a secondary filter.

In some embodiments, the vacuum source applies the vacuum over the entirety of an exposed portion of a dirt collection chamber, such as over the walls of a dirt collection chamber formed of an air filter material. Such an arrangement can provide a sufficient volume air flow without undue pressure drop across the air filter. In some embodiments, the dirt collection chamber protrudes upwardly from the cleaning head to allow the connector to apply vacuum to the dirt collection chamber material. In such embodiments, this arrangement may allow the bag to fill toward the periphery of the bag and then to fill the bag toward the middle of the bag.

Figure 28:
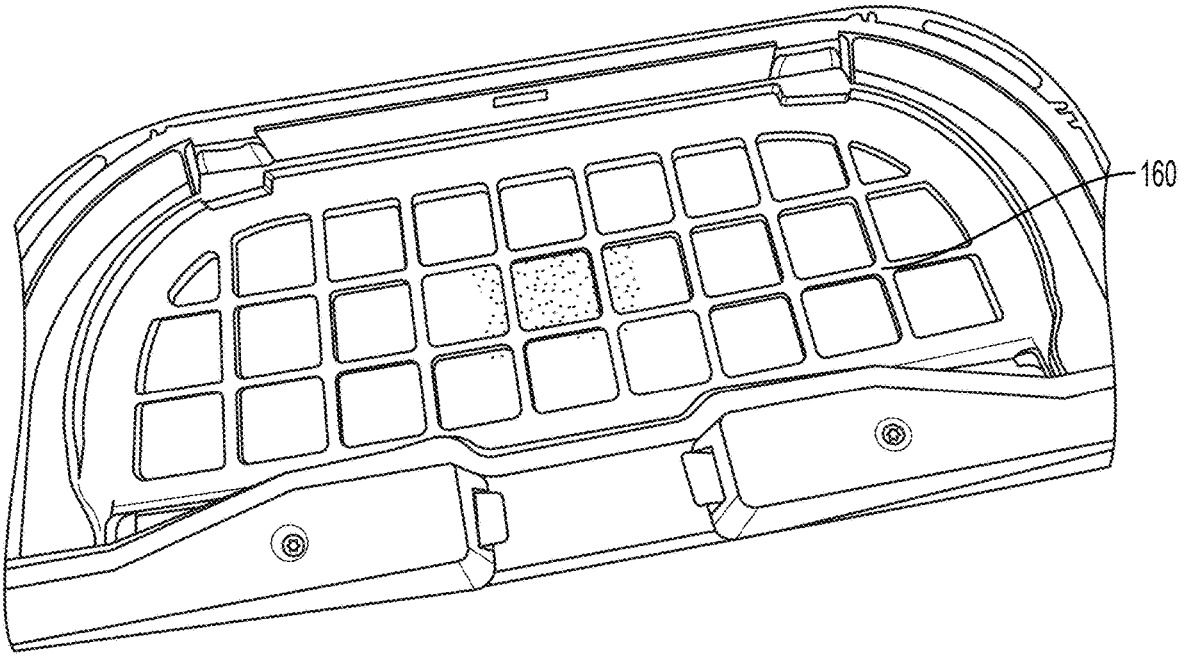
FIG. 28 shows a connector of a cleaning device.

In some embodiments, as shown in FIG. 28, a lower side of the connector includes one or more posts 160 to space the dirt collection chamber from the vacuum source. In some embodiments, the connector may have 30-40 posts, though any number of suitable posts may be used. Such a separation may allow the vacuum to be applied across and around the entire exterior of the exposed portion of the dirt collection chamber.

In some embodiments, the cleaning device, may include a spray nozzle 155 arranged to apply a liquid to a surface be cleaned. In some embodiments, the spray nozzle may be located on the body of the cleaning device. The spray nozzle also may be located on the connector. As will be appreciated, the spray nozzle may be located in any suitable location for applying the liquid to the surface to be cleaned.

In some embodiments, the device may include a liquid reservoir 159 that is arranged to supply a liquid to the spray nozzle. In some embodiments, the reservoir may be permanently attached to the cleaning devices, such as permanently attached to the body. The reservoir also may be removably attachable to the cleaning device. In some embodiments, the user may add a cleaning liquid and/or water to the liquid reservoir, such as through a filling port on reservoir. In some embodiments, the liquid reservoir may be sized to include a volume of liquid for several cleaning events. In such embodiments, the user need only attach a cleaning head prior to operating the cleaning device. In some embodiments, the liquid reservoir may be pre-filled, such that the user may purchase one or more liquid reservoirs that the user may attach to the cleaning device when the liquid reservoir is empty.

In some embodiments, the handle includes an actuator 157 to allow the user to activate the spray nozzle to apply a liquid to a surface to be cleaned.

In some embodiments, the cleaning device may be battery operated. In such embodiments, the battery may be rechargeable. In such embodiments, the user may charge the battery in between uses. In some embodiments, battery is arranged to maintain power for one, two, three or more cleaning events. In some embodiments, the batteries are replaceable. In some embodiments, the cleaning device may be powered by an electrical cord plugged into an electrical outlet.

Figure 26:
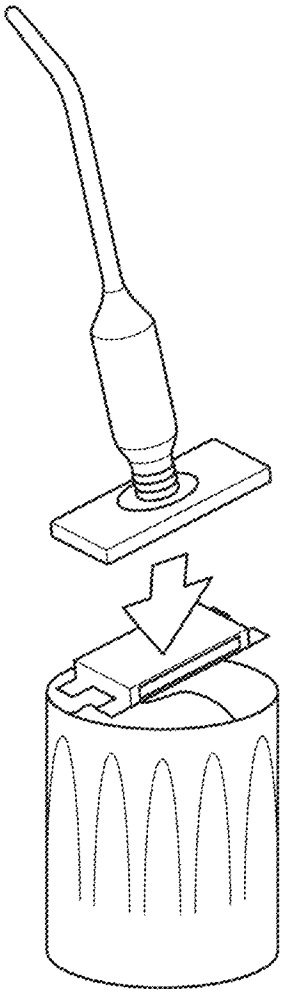
FIG. 26 shows the cleaning head being disposed.
Figure 25:
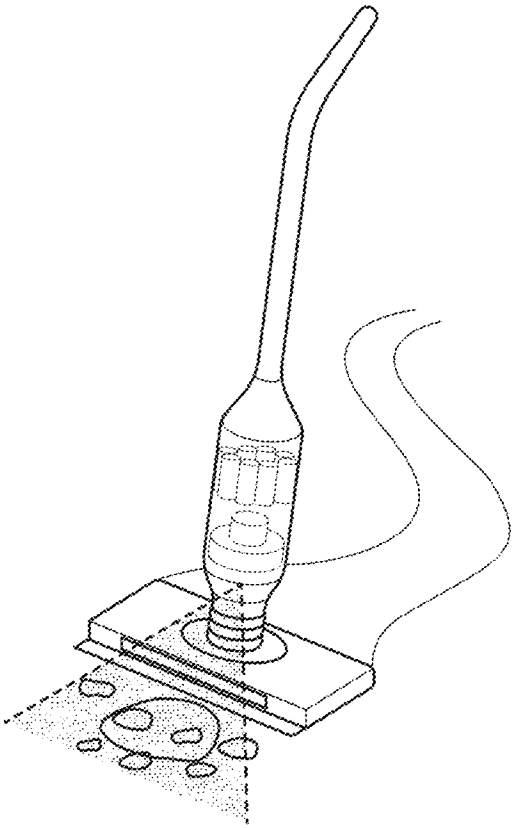
FIG. 25 shows the cleaning device spraying liquid onto the floor.
Figure 24:
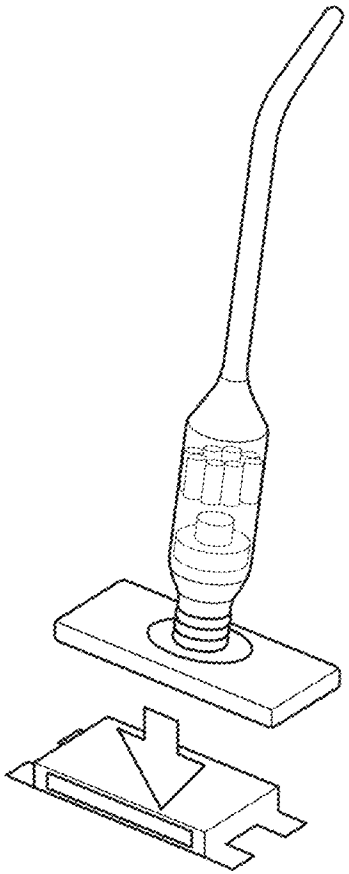
FIG. 24 shows the cleaning head being connected to the cleaning device according to one embodiment.
Figure 23:
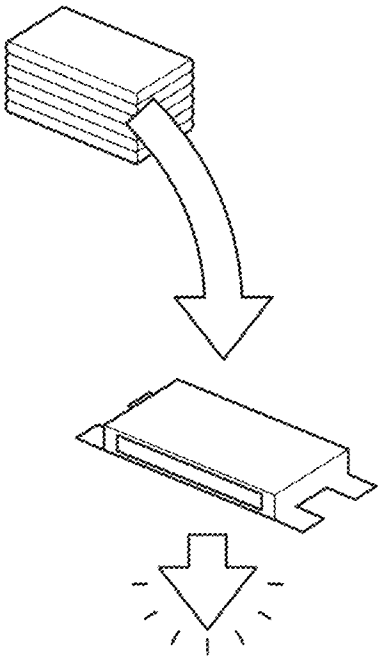
FIG. 23 shows a cleaning head being placed on the floor according to one method of using a cleaning device according to embodiments disclosed herein.

According to another embodiment, as shown in FIGS. 23-26, a method of using a cleaning device is disclosed. As shown in FIG. 23, the user may select a first cleaning head from a box of disposable cleaning heads. Next, the user attaches a first cleaning head to the cleaning device (FIG. 24). In such embodiments, attaching the first cleaning head includes attaching the cleaning head to a connector of the cleaning device. In some embodiments, the cleaning head includes a dirt collection receptacle permanently attached to the cleaning head. The cleaning head also may include a cleaning sheet and a suction nozzle attached to the cleaning head. The method includes operating the cleaning device to move dirt through the suction nozzle and into the dirt collection chamber. In some embodiments, the user may apply a liquid to the surface to be cleaned (see FIG. 25). The method also includes removing the cleaning head from the connector and disposing the cleaning head in a trash receptacle (FIG. 26).

In embodiments in which a cleaning sheet is attached to the cleaning head, wet and dry debris may be cleaned separately or simultaneously. For example, in some embodiments, the vacuum source may be turned on such that debris may be moved from the surface into the dirt collection receptacle. Dry debris already on the floor also may be picked up by the cleaning sheet while the vacuum source is turned on. In some embodiments, the surface also may include a wet spill, which may be absorbed by the cleaning sheet while the vacuum source is turned on. As will be appreciated, the cleaning device may be used only as a vacuum cleaner in some embodiments. In some embodiments, while the vacuum source is on, the user may operate the spray nozzle (e.g., by pressing an actuator) to apply a liquid to the surface to be cleaned. In such embodiments, the cleaning device may be operated as a vacuum and as a mop at the same time. In some embodiments, the user may spray liquid onto the surface in the path of the cleaning head such that the wet debris is absorbed into the cleaning sheet at the same time that the vacuum moves debris from the surface into the dirt collection chamber. In some embodiments, the liquid may be sprayed onto the floor in a fan pattern, although the liquid may be sprayed on to the floor in other suitable patterns.

As will be appreciated, the cleaning device also may be operated as only a mop. In such instances, the user may simply operate the spray nozzle (e.g., by pressing the actuator) to apply the liquid to the surface to be cleaned. In such embodiments, the user may move the cleaning device back and forth to clean the floor. In embodiments in which the cleaning sheet is removably attached to the cleaning head, the user may remove and discard the cleaning sheet. In embodiments in which the cleaning sheet is permanently attached to the cleaning head, the user may discard the cleaning head after using the cleaning device as a mop.

In some embodiments, disposing the cleaning head includes discarding the cleaning head with the dirt and debris contained in the dirt collection receptacle and/or absorbed in the cleaning sheet. In some embodiments, disposing the cleaning head includes activating a release mechanism. For example, the release mechanism may move first and second jaw members away from one another to release the fastener from between the jaws and allow the cleaning head to fall away from the connector. As will be appreciated, in such embodiments, because the user is only activating a release mechanism, the user may not handle the wet or dirty cleaning head. As will be further appreciated, because the cleaning head is the only part of the cleaning head to contact the surface and all of the wet and/or dry debris is contained within the cleaning head, the remainder of the cleaning device (e.g., the connector and body) may be clean throughout and after operation of the cleaning device.

For purposes herein, containing the debris in the dirt collection chamber means that the dirt collection chamber is not openable by the user to dispose dirt collected in the dirt collection chamber. Instead, as described above, the cleaning head, with the entrained debris, is discarded in the trash receptacle. As will be appreciated, a user may rip or cut open the dirt collection chamber to allow debris to be emptied into a trash receptacle, however, such an action may damage the dirt collection chamber and may prevent the user from continuing to use the cleaning head. In a similar manner, the user also may break or pry open the dirt trap. As with the previous example, this action also may damage the cleaning head such that the cleaning head may no longer be usable with the cleaning device.

Figure 27:
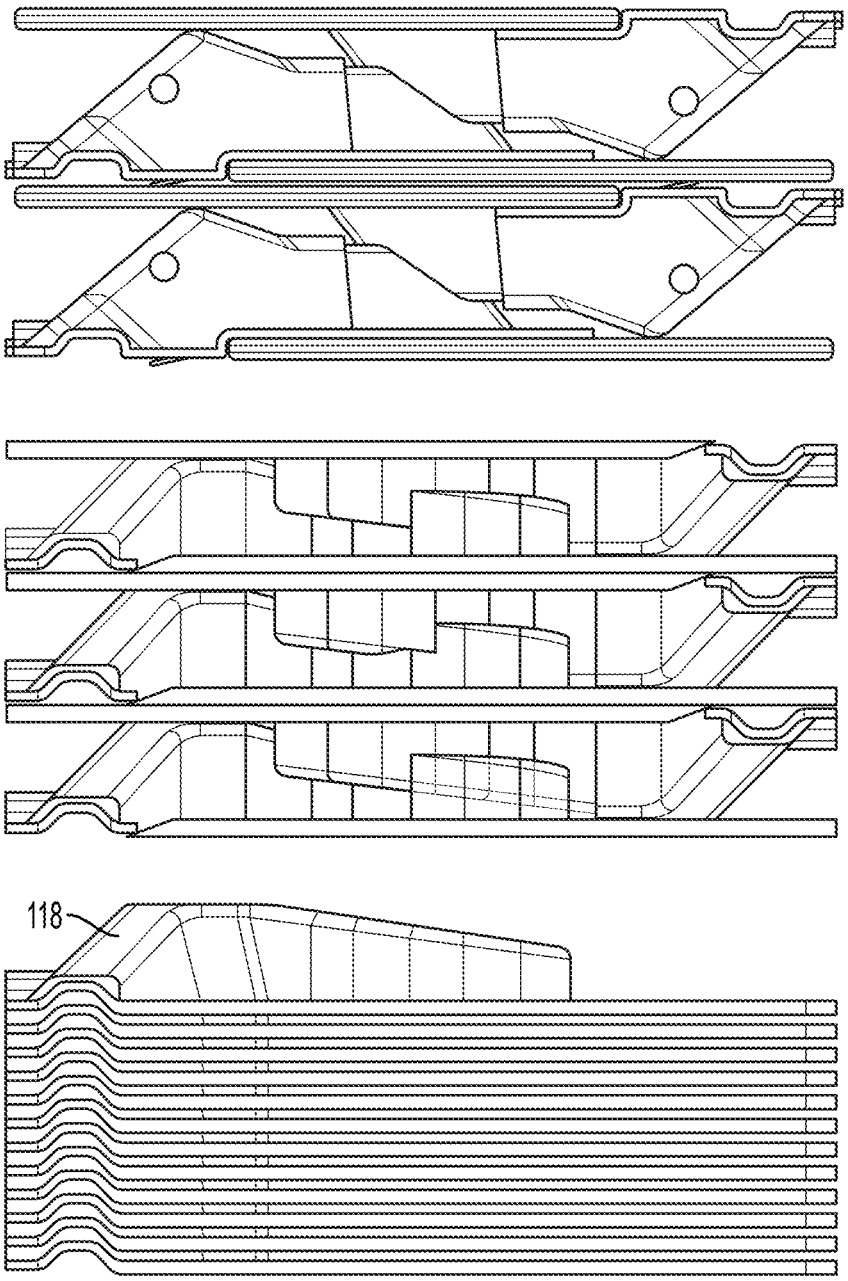
FIG. 27 illustrates stacked cleaning heads.

In some embodiments, as shown in FIG. 27, the cleaning heads may be stackable on top of one another. In some embodiments, the cleaning heads may be nested into a stack. In such embodiments, the suction nozzle of a first cleaning head may be nested within a suction nozzle of a second cleaning head. In some embodiments, the dirt collection chambers are collapsible to allow a first cleaning head to be stackable on top of a second cleaning head. In such embodiments, a first dirt collection chamber of a first cleaning head may be collapsed below a support structure of a second cleaning head. The first collection chamber also may be collapsed below a cleaning sheet attached to a second cleaning sheet.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. A method of using a cleaning device, the cleaning device comprising a vacuum source, a body including a handle, and a connector to removably connect a cleaning head to the device, the method comprising:

attaching a first cleaning head to the connector, the first cleaning head including a first suction nozzle and a first dirt collection chamber;

operating the device to move dirt through the first suction nozzle and into the first dirt collection chamber;

removing the first cleaning head from the connector;

disposing of the first cleaning head;

attaching a second cleaning head to the connector, the second cleaning head including a second suction nozzle and a second dirt collection chamber.

2. A method as in claim 1, wherein the dirt collection chamber is permanently attached to the cleaning head.

3. A method as in claim 1, wherein the cleaning head includes a support for a cleaning sheet.

4. A method as in claim 1, further comprising, prior to removing:

applying a cleaning liquid to the surface; and moving the first cleaning head across the surface, a cleaning sheet being attached to a lower surface of the cleaning head.

5. A method of using a cleaning device, the cleaning device comprising a body, a handle, a vacuum source, and a head attached to the body, the method comprising:

attaching a first dirt collection chamber support with an attached first dirt collection chamber to an underside of the head such that a suction nozzle is fluidically connected to the first dirt collection chamber;

operating the device to suction dirt from a surface and into the first dirt collection chamber;

removing the first dirt collection chamber support and attached first dirt collection chamber from the head;

disposing of the first dirt collection chamber support and attached first dirt collection chamber;

attaching a second dirt collection chamber support with an attached second dirt collection chamber to the underside of the head such that a suction nozzle is fluidically connected to the second dirt collection chamber.

6. A method as in claim 5, wherein the dirt collection chamber is permanently attached to the cleaning head.

7. A method as in claim 5, wherein the cleaning head includes a support for a cleaning sheet.

8. A method as in claim 5, further comprising, prior to removing:

applying a cleaning liquid to the surface; and moving the first cleaning head across the surface, a cleaning sheet being attached to a lower surface of the cleaning head.

* * * * *